US011727882B2

(12) United States Patent
Kim et al.

(10) Patent No.: US 11,727,882 B2
(45) Date of Patent: Aug. 15, 2023

(54) PIXEL AND DISPLAY DEVICE

(71) Applicant: Samsung Display Co., Ltd., Yongin-si (KR)

(72) Inventors: Hanbit Kim, Seoul (KR); Meejae Kang, Suwon-si (KR); Keunwoo Kim, Seongnam-si (KR); Doo-Na Kim, Seongnam-si (KR); Sangsub Kim, Suwon-si (KR); Do Kyeong Lee, Yongin-si (KR); Jaehwan Chu, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/489,399

(22) Filed: Sep. 29, 2021

(65) Prior Publication Data

US 2022/0180811 A1 Jun. 9, 2022

(30) Foreign Application Priority Data

Dec. 9, 2020 (KR) ..... 10-2020-0171683

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0426* (2013.01)

(58) Field of Classification Search
CPC ..... G09G 3/3233; G09G 2310/06; G09G 2310/0251
See application file for complete search history.

(56) References Cited

U.S. PATENT DOCUMENTS

| | | | |
|---|---|---|---|
| 7,248,494 | B2 | 7/2007 | Oh et al. |
| 9,355,594 | B2 | 5/2016 | Lee et al. |
| 10,249,236 | B2 | 4/2019 | Choi |
| 10,325,557 | B2 | 6/2019 | Cho |
| 10,878,754 | B2 | 12/2020 | Kim et al. |

(Continued)

FOREIGN PATENT DOCUMENTS

| | | | |
|---|---|---|---|
| KR | 10-0610014 | B1 | 8/2006 |
| KR | 10-2016-0024191 | A | 3/2016 |

(Continued)

*Primary Examiner* — Van N Chow
(74) *Attorney, Agent, or Firm* — Lewis Roca Rothgerber Christie LLP

(57) ABSTRACT

A pixel includes: a capacitor connected between a first voltage line and a first node; a light emitting diode including a first electrode connected to a second node, and a second electrode connected to a second voltage line; a first transistor; a second transistor; a third transistor including a first electrode connected to the first node, a second electrode connected to the second node, and a gate electrode to receive a first scan signal; a fourth transistor including a first electrode connected to the first node, a second electrode connected to a third voltage line to receive a third voltage, and a gate electrode to receive a second scan signal; and a compensation transistor including a first electrode connected to the first node, a second electrode connected to a fourth voltage line to receive a compensation voltage, and a gate electrode to receive a compensation control voltage.

20 Claims, 10 Drawing Sheets

(56) References Cited

U.S. PATENT DOCUMENTS

| | | | | |
|---|---|---|---|---|
| 2018/0151115 | A1* | 5/2018 | Tseng | G09G 3/325 |
| 2019/0237020 | A1 | 8/2019 | Park et al. | |
| 2021/0335953 | A1* | 10/2021 | Kim | H01L 27/3265 |
| 2022/0044635 | A1* | 2/2022 | Roh | G09G 3/3266 |
| 2022/0051625 | A1* | 2/2022 | Lai | G09G 3/3233 |

FOREIGN PATENT DOCUMENTS

| | | | |
|---|---|---|---|
| KR | 10-2017-0045781 | A | 4/2017 |
| KR | 10-2017-0060219 | A | 6/2017 |
| KR | 10-2018-0032256 | A | 3/2018 |
| KR | 10-2019-0093827 | A | 8/2019 |
| KR | 10-2019-0111170 | A | 10/2019 |

* cited by examiner

PIXEL AND DISPLAY DEVICE

CROSS-REFERENCE TO RELATED APPLICATIONS

This application claims priority to and the benefit of Korean Patent Application No. 10-2020-0171683, filed on Dec. 9, 2020, in the Korean Intellectual Property Office, the entire disclosure of which is incorporated by reference herein.

BACKGROUND

Aspects of embodiments of the present disclosure relate to a display device.

A display device may be a device composed of various electronic components, for example, such as a display panel for displaying an image, an input sensor for detecting an external input, and an electronic module. The electronic components may be electrically connected to one another by variously arranged signal lines. The display panel includes a plurality of pixels. Each of the plurality of pixels includes a light emitting device that generates light, and a circuit unit that controls an amount of current flowing to the light emitting device.

When a leakage current occurs in the circuit unit of the pixel, display quality may be deteriorated due to a change in the amount of current flowing through the light emitting element.

The above information disclosed in this Background section is for enhancement of understanding of the background of the present disclosure, and therefore, it may contain information that does not constitute prior art.

SUMMARY

One or more embodiments of the present disclosure are directed to a pixel, and a display device capable of preventing or reducing deterioration in the display quality of an image.

According to one or more embodiments of the present disclosure, a pixel includes: a capacitor electrically connected between a first voltage line and a first node, the first voltage line being configured to receive a first voltage; a light emitting diode including a first electrode electrically connected to a second node, and a second electrode electrically connected to a second voltage line; a first transistor including a first electrode electrically connected to the first voltage line, a second electrode connected to the second node, and a gate electrode electrically connected to the first node; a second transistor including a first electrode connected to a data line, a second electrode electrically connected to the first electrode of the first transistor, and a gate electrode configured to receive a first scan signal; a third transistor including a first electrode electrically connected to the first node, a second electrode electrically connected to the second node, and a gate electrode configured to receive the first scan signal; a fourth transistor including a first electrode electrically connected to the first node, a second electrode electrically connected to a third voltage line configured to receive a third voltage, and a gate electrode configured to receive a second scan signal; and a compensation transistor including a first electrode electrically connected to the first node, a second electrode electrically connected to a fourth voltage line configured to receive a compensation voltage, and a gate electrode configured to receive a compensation control voltage.

In an embodiment, the pixel may further include: a fifth transistor connected between the first voltage line and the first electrode of the first transistor; a sixth transistor connected between the second node and the first electrode of the light emitting diode; and a seventh transistor connected between the third voltage line and the first electrode of the light emitting diode, and including a gate electrode configured to receive a third scan signal.

In an embodiment, the compensation voltage may have a voltage level to compensate for a leakage current of the third transistor and a leakage current of the fourth transistor.

In an embodiment, the compensation control voltage may have a voltage level configured to maintain the compensation transistor in a turned-off state.

In an embodiment, each of the third transistor, the fourth transistor, and the compensation transistor may include a P-type transistor.

In an embodiment, the third transistor may include: a first sub-transistor including a first electrode connected to the first node, a second electrode, and a gate electrode configured to receive the first scan signal; and a second sub-transistor including a first electrode connected to the second electrode of the first sub-transistor, a second electrode connected to the second node, and a gate electrode configured to receive the first scan signal.

In an embodiment, the fourth transistor may include: a first sub-transistor including a first electrode connected to the first node, a second electrode, and a gate electrode configured to receive the second scan signal; and a second sub-transistor including a first electrode connected to the second electrode of the first sub-transistor, a second electrode connected to the third voltage line, and a gate electrode configured to receive the second scan signal.

According to one or more embodiments of the present disclosure, a pixel includes: a capacitor electrically connected between a first voltage line and a first node, the first voltage line being configured to receive a first voltage; a light emitting diode including a first electrode electrically connected to a second node, and a second electrode electrically connected to a second voltage line; a first transistor including a first electrode electrically connected to the first voltage line, a second electrode connected to the second node, and a gate electrode electrically connected to the first node; a second transistor including a first electrode connected to a data line, a second electrode electrically connected to the first electrode of the first transistor, and a gate electrode configured to receive a first scan signal; a third transistor including a first electrode electrically connected to the first node, a second electrode electrically connected to the second node, and a gate electrode configured to receive the first scan signal; a fourth transistor including a first electrode electrically connected to the first node, a second electrode electrically connected to a third voltage line configured to receive a third voltage, and a gate electrode configured to receive a second scan signal; and a compensation transistor including a first electrode electrically connected to the second node, a second electrode electrically connected to a fourth voltage line configured to receive a compensation voltage, and a gate electrode configured to receive a compensation control voltage.

In an embodiment, the pixel may further include: a fifth transistor connected between the first voltage line and the first electrode of the first transistor; a sixth transistor connected between the second node and the first electrode of the light emitting diode; and a seventh transistor connected between the third voltage line and the first electrode of the light emitting diode, and including a gate electrode configured to receive a third scan signal.

In an embodiment, the compensation voltage may have a voltage level to compensate for a leakage current of the third transistor and a leakage current of the fourth transistor.

In an embodiment, the compensation control voltage may have a voltage level configured to maintain the compensation transistor in a turned-off state.

In an embodiment, each of the third transistor, the fourth transistor, and the compensation transistor may include a P-type transistor.

In an embodiment, the third transistor may include: a first sub-transistor including a first electrode connected to the first node, a second electrode, and a gate electrode configured to receive the first scan signal; and a second sub-transistor including a first electrode connected to the second electrode of the first sub-transistor, a second electrode connected to the second node, and a gate electrode configured to receive the first scan signal.

In an embodiment, the fourth transistor may include: a first sub-transistor including a first electrode connected to the first node, a second electrode, and a gate electrode configured to receive the second scan signal; and a second sub-transistor including a first electrode connected to the second electrode of the first sub-transistor, a second electrode connected to the third voltage line, and a gate electrode configured to receive the second scan signal.

According to one or more embodiments of the present disclosure, a display device includes: a pixel; and a scan driving circuit configured to output a first scan signal and a second scan signal for driving the pixel. The pixel includes: a capacitor electrically connected between a first voltage line and a first node, the first voltage line being configured to receive a first voltage; a light emitting diode including a first electrode electrically connected to a second node, and a second electrode electrically connected to a second voltage line configured to receive a second voltage; a first transistor including a first electrode electrically connected to the first voltage line, a second electrode connected to the second node, and a gate electrode electrically connected to the first node; a second transistor including a first electrode connected to a data line, a second electrode electrically connected to the first electrode of the first transistor, and a gate electrode configured to receive the first scan signal; a third transistor including a first electrode electrically connected to the first node, a second electrode electrically connected to the second node, and a gate electrode configured to receive the first scan signal; a fourth transistor including a first electrode electrically connected to the first node, a second electrode electrically connected to a third voltage line configured to receive a third voltage, and a gate electrode configured to receive the second scan signal; and a compensation transistor including a first electrode electrically connected to the first node, a second electrode electrically connected to a fourth voltage line configured to receive a compensation voltage, and a gate electrode configured to receive a compensation control voltage.

In an embodiment, the display device may further include: a fifth transistor connected between the first voltage line and the first electrode of the first transistor; a sixth transistor connected between the second node and the first electrode of the light emitting diode; and a seventh transistor connected between the third voltage line and the first electrode of the light emitting diode, and including a gate electrode configured to receive a third scan signal.

In an embodiment, the display device may further include: a voltage generator configured to generate the first voltage, the second voltage, the third voltage, the compensation voltage, and the compensation control voltage.

In an embodiment, the voltage generator may be configured to control a voltage level of the compensation voltage to correspond to a difference between a leakage current of the third transistor and a leakage current of the fourth transistor.

In an embodiment, the voltage generator may be configured to control a voltage level of the compensation control voltage to maintain the compensation transistor in a turned-off state.

In an embodiment, each of the third transistor, the fourth transistor, and the compensation transistor may include a P-type transistor.

BRIEF DESCRIPTION OF THE FIGURES

The above and other aspects and features of the present disclosure will be more clearly understood from the following detailed description of the illustrative, non-limiting example embodiments with reference to the accompanying drawings.

DETAILED DESCRIPTION

Figure 1:
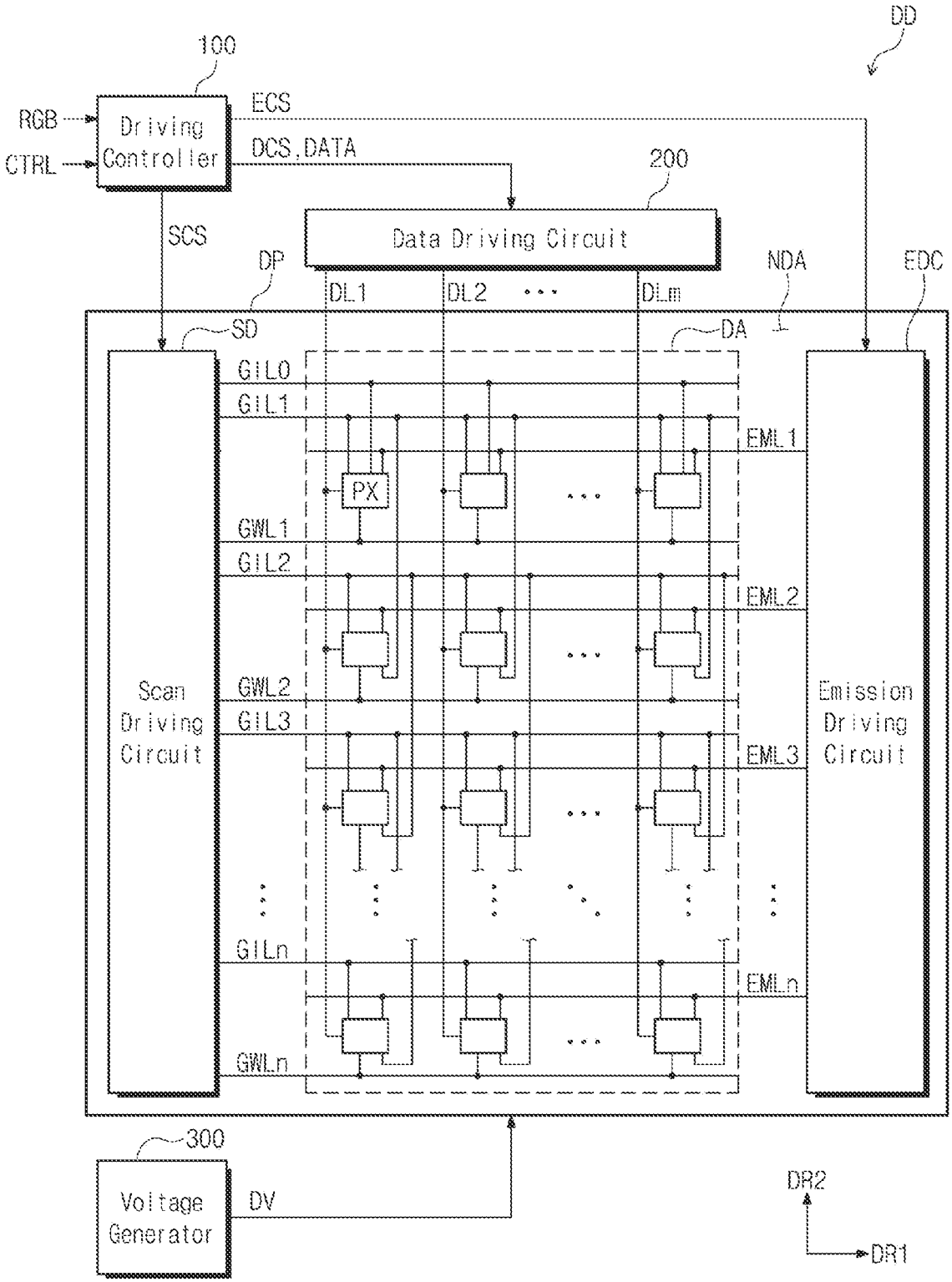
FIG. 1 is a block diagram of a display device according to an embodiment of the present disclosure.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

When a certain embodiment may be implemented differently, a specific process order may be different from the described order. For example, two consecutively described processes may be performed at the same or substantially at the same time, or may be performed in an order opposite to the described order.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. These terms are relative, and are described with reference to the directions indicated in the drawings. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. Similarly, when a layer, an area, or an element is referred to as being "electrically connected" to another layer, area, or element, it may be directly electrically connected to the other layer, area, or element, and/or may be indirectly electrically connected with one or more intervening layers, areas, or elements therebetween. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, the expression "A and/or B" denotes A, B, or A and B. Expressions such as "at least one of," when preceding a list of elements, modify the entire list of elements and do not modify the individual elements of the list. For example, the expression "at least one of a, b, or c" indicates only a, only b, only c, both a and b, both a and c, both b and c, all of a, b, and c, or variations thereof.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram of a display device according to an embodiment of the present disclosure.

Referring to FIG. 1, a display device DD includes a display panel DP, a driving controller 100, a data driving circuit 200, and a voltage generator 300.

The driving controller 100 receives an image input signal RGB and a control signal CTRL. The image input signal RGB and the control signal CTRL may be provided from a main controller (or graphic processor).

The driving controller 100 generates an image data signal DATA obtained by converting a data format of the image input signal RGB according to (e.g., to meet) a specification of an interface with the data driving circuit 200. The driving controller 100 outputs a scan control signal SCS and a data control signal DCS.

The data driving circuit 200 receives the data control signal DCS and the image data signal DATA from the driving controller 100. The data driving circuit 200 converts the image data signal DATA into data signals, and outputs the data signals to a plurality of data lines DL1 to DLm, which will be described in more detail below. The data signals may be analog voltages corresponding to gray scale values of the image data signal DATA.

The voltage generator 300 generates suitable voltages used for an operation of the display panel DP. In an embodiment, the voltage generator 300 generates driving voltages DV. The driving voltages DV may include a plurality of voltages having different voltage levels from one another. For example, the driving voltages DV may include a first driving voltage ELVDD, a second driving voltage ELVSS, an initialization voltage VINT, a compensation control voltage VGH, and a compensation voltage VCOMP, which will be described in more detail below.

The display panel DP includes first scan lines GIL0 to GILn, second scan lines GWL1 to GWLn, emission control lines EML1 to EMLn, the data lines DL1 to DLm, and pixels PX, where n and m are natural numbers. The display panel DP may further include a scan driving circuit SD and an emission driving circuit EDC. In an embodiment, the scan driving circuit SD may be arranged at (e.g., in or on) a first side of the display panel DP. The first scan lines GIL0 to GILn and the second scan lines GWL1 to GWLn extend in a first direction DR1 from the scan driving circuit SD, and the emission control lines EML1 to EMLn extend in the first direction DR1 from the emission driving circuit EDC. In an embodiment, the pixels PX are arranged in a display area DA and the scan driving circuit SD and the emission driving circuit EDC are arranged in a non-display area NDA.

The emission driving circuit EDC receives the emission driving signal ECS from the driving controller 100. The emission driving circuit EDC may be arranged at (e.g., in or on) a second side of the display panel DP. For example, in an embodiment, the second side of the display panel DP may be opposite to the first side of the display panel DP with the pixels PX arranged therebetween. The emission control lines EML1 to EMLn extend in a direction opposite to the first direction DR1 from the emission driving circuit EDC.

The first scan lines GIL0 to GILn, the second scan lines GWL1 to GWLn, and the emission control lines EML1 to EMLn are arranged to be spaced apart from one another in a second direction DR2. The data lines DL1 to DLm extend in a direction opposite to the second direction DR2 from the data driving circuit 200, and are arranged to be spaced apart from one another in the first direction DR1.

In an example illustrated in FIG. 1, the scan driving circuit SD and the emission driving circuit EDC are arranged to face each other with the pixels PX interposed therebetween, but the present disclosure is not limited thereto. For example, the scan driving circuit SD and the emission driving circuit EDC may be disposed to be adjacent to each other at (e.g., in or on) one of the first side or the second side of the display panel DP. In an embodiment, the scan driving circuit SD and the emission driving circuit EDC may be configured as one circuit (e.g., as the same circuit or as parts of the same circuit).

The plurality of pixels PX are electrically connected to the first scan lines GIL0 to GILn, the second scan lines GWL1 to GWLn, the emission control lines EML1 to EMLn, and the data lines DL1 to DLm. Each of the plurality of pixels PX may be electrically connected to three scan lines and one emission control line. For example, as illustrated in FIG. 1, the pixels PX in a first row may be connected to the scan lines GIL0, GIL1, and GWL1 and the emission control line EML1. In addition, the pixels PX in a second row may be connected to the scan lines GIL1, GIL2, and GWL2 and the emission control line EML2.

Each of the plurality of pixels PX may include an organic light emitting diode ED (e.g., refer to FIG. 2A), and a circuit unit (e.g., a pixel circuit) PXC (e.g., refer to FIG. 5) that controls light emission of the light emitting diode ED. The circuit unit PXC may include a plurality of transistors and one or more capacitors. The scan driving circuit SD may include transistors formed through the same or substantially the same process as those of the circuit unit PXC.

Each of the plurality of pixels PX receives the first driving voltage ELVDD, the second driving voltage ELVSS, the initialization voltage VINT, the compensation control voltage VGH, and the compensation voltage VCOMP from the voltage generator 300.

The scan driving circuit SD receives the scan control signal SCS from the driving controller 100. The scan driving circuit SD may output first scan signals to the first scan lines GIL0 to GILn and second scan signals to the second scan lines GWL1 to GWLn in response to the scan control signal SCS. The circuit configuration and operations of the scan driving circuit SD will be described in more detail below.

Figure 2A:
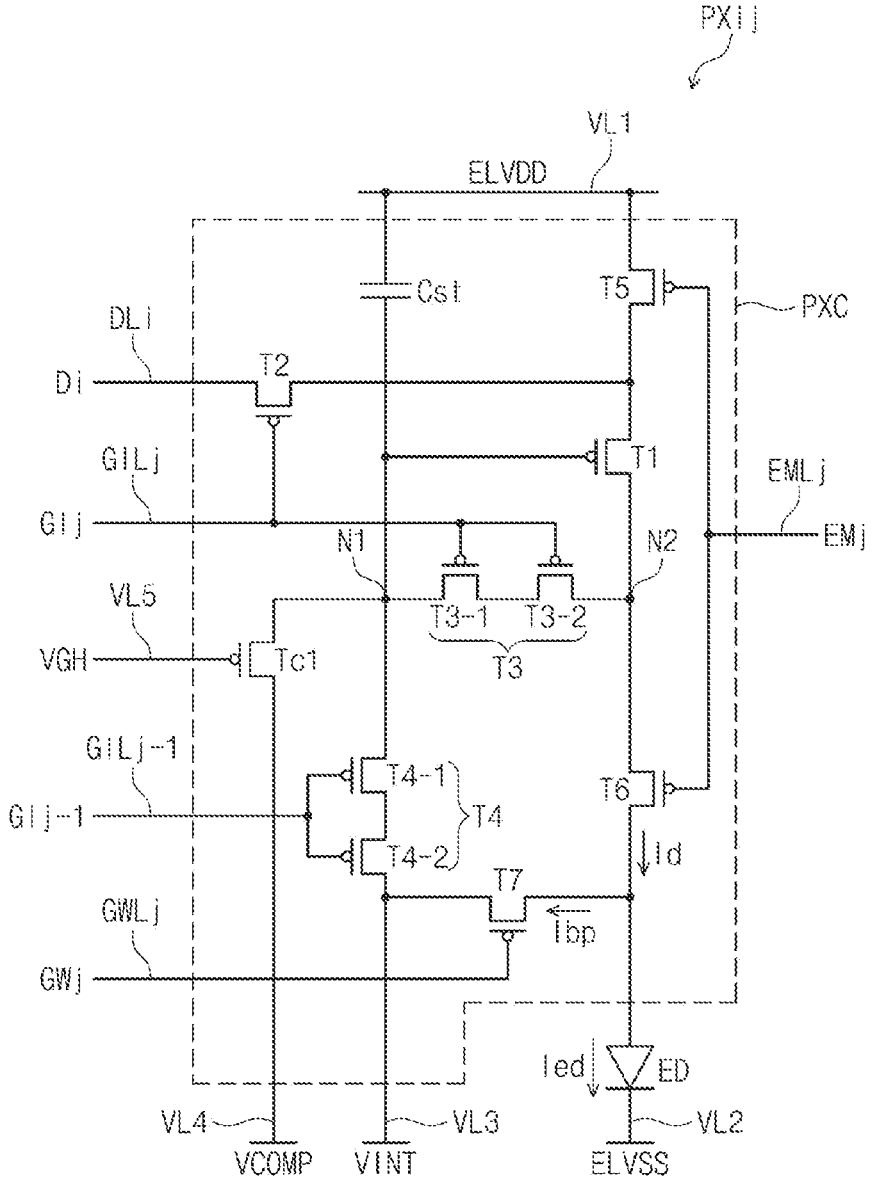
FIG. 2A is an equivalent circuit diagram of a pixel according to an embodiment of the present disclosure.

FIG. 2A is an equivalent circuit diagram of a pixel according to an embodiment of the present disclosure.

FIG. 2A illustrates an equivalent circuit diagram of a pixel PXij connected to an i-th data line DLi of the data lines DL1 to DLm, a (j−1)-th first scan line GILj−1 and a j-th first scan line GILj of the first scan lines GIL0 to GILn, a j-th second scan line GWLj of the second scan lines GWL1 to GWLn, and a j-th emission control line EMLj of the emission control lines EML1 to EMLn, from among those illustrated in FIG. 1 as an example.

Each of the plurality of pixels PX illustrated in FIG. 1 may have the same or substantially the same circuit configuration as that of the equivalent circuit diagram of the pixel PXij illustrated in FIG. 2A, but connected to corresponding ones of the first scan lines GIL0 to GILn, the second scan lines GWL1 to GWLn, and the emission control lines EML1 to EMLn.

Referring to FIG. 2A, the pixel PXij includes at least one light emitting diode ED, and the circuit unit PXC. In an embodiment, an example in which one-pixel PXij includes one light emitting diode ED will be described in more detail hereinafter, but the present disclosure is not limited thereto.

The circuit unit PXC includes first to seventh transistors T1 to T7, a compensation transistor Tc1, and a capacitor Cst. Each of the first to seventh transistors T1 to T7 and the compensation transistor Tc1 may be a P-type transistor having a low-temperature polycrystalline silicon (LTPS) semiconductor layer. However, the present disclosure is not limited thereto, and one or more of (e.g., each of) the first to seventh transistors T1 to T7 and the compensation transistor Tc1 may be an N-type transistor using an oxide semiconductor as a semiconductor layer. In an embodiment, at least one of the first to seventh transistors T1 to T7 and the compensation transistor Tc1 may be an N-type transistor, and the others thereof may be a P-type transistor. In addition, the circuit configuration of the pixel PXij according to embodiments of the present disclosure is not limited to that shown in FIG. 2A. The circuit unit PXC illustrated in FIG. 2A is provided only as an example, and the configuration of the circuit unit PXC may be variously modified and implemented as needed or desired.

The (j−1)-th first scan line GILj−1, the j-th first scan line GILj, the j-th second scan line GWLj, and the j-th emission control line EMLj may transfer a (j−1)-th first scan signal GIj−1, a j-th first scan signal GIj, a j-th second scan signal GW, and an j-th emission control signal EMj, respectively. The i-th data line DLi transfers a data signal Di. The i-th data signal Di may have a voltage level corresponding to the image input signal RGB that is input to the display device DD (e.g., refer to FIG. 1). First to fifth driving voltage lines VL1, VL2, VL3, VL4, and VL5 may transfer the first driving voltage ELVDD, the second driving voltage ELVSS, the initialization voltage VINT, the compensation voltage VCOMP, and the compensation control voltage VGH, respectively.

The first transistor T1 includes a first electrode connected to the first driving voltage line VL1 through the fifth transistor T5, a second electrode electrically connected to an anode of the light emitting diode ED through the sixth transistor T6, and a gate electrode connected to one end of the capacitor Cst. The first transistor T1 may receive the data signal Di transferred from the data line DLi depending on a switching operation of the second transistor T2, and may supply a driving current Id to the light emitting diode ED.

The second transistor T2 includes a first electrode connected to the data line DLi, a second electrode connected to the first electrode of the first transistor T1, and a gate electrode connected to the j-th first scan line GILj. The second transistor T2 is turned on based on the first scan signal GIj transferred through the j-th first scan line GILj, and may transfer the data signal Di transferred from the data line DLi to the first electrode of the first transistor T1.

The third transistor T3 includes third sub-transistors T3-1 and T3-2. The third sub-transistors T3-1 and T3-2 may be connected in series between a first node N1 and a second node N2. A first electrode of the third sub-transistor T3-1 is connected to the first node N1, which is connected to the gate electrode of the first transistor T1. A second electrode of the third sub-transistor T3-2 is connected to the second node N2, which is connected to the second electrode of the first transistor T1. The gate electrodes of the third sub-transistors T3-1 and T3-2 are connected to the j-th first scan line GILj.

The third sub-transistors T3-1 and T3-2 are turned on in response to the first scan signal GIj received through the j-th first scan line GILj, and thus, electrically connect the gate electrode of the first transistor T1 to the second electrode of the first transistor T1. In more detail, the first transistor T1 may be diode-connected by the third sub-transistors T3-1 and T3-2.

In FIG. 2A, the third transistor T3 is illustrated as including the third sub-transistors T3-1 and T3-2 that are connected in series to each other, but the present disclosure is not limited thereto. In an embodiment, the third transistor T3 may be configured as only one transistor. In this case, the third transistor T3 may include a first electrode connected to the first node N1, a second electrode connected to the second node N2, and a gate electrode connected to the first scan line GILj. In an embodiment, the third transistor T3 may include three or more transistors that are connected between the first node N1 and the second node N2.

The fourth transistor T4 includes fourth sub-transistors T4-1 and T4-2. The fourth sub-transistors T4-1 and T4-2 are connected in series between the first node N1 and the third driving voltage line VL3 through which the initialization voltage VINT is transferred. A first electrode of the fourth sub-transistor T4-1 is connected to the first node N1. A second electrode of the fourth sub-transistor T4-2 is connected to the third driving voltage line VL3. The gate electrodes of the fourth sub-transistors T4-1 and T4-2 are connected to the (j−1)-th first scan line GILj−1.

The fourth sub-transistors T4-1 and T4-2 are turned on in response to the first scan signal GIj−1 received through the (j−1)-th first scan line GILj−1, and may transfer the initialization voltage VINT to the gate electrode of the first transistor T1 (e.g., to the first node N1). Accordingly, an initialization operation that initializes a voltage of the gate electrode of the first transistor T1 may be performed.

In FIG. 2A, the fourth transistor T4 is illustrated as including the fourth sub-transistors T4-1 and T4-2 that are connected in series to each other, but the present disclosure is not limited thereto. In an embodiment, the fourth transistor T4 may be configured as only one transistor. In this case, the fourth transistor T4 may include a first electrode connected to the first node N1, a second electrode connected to the third driving voltage line VL3, and a gate electrode connected to the (j−1)-th first scan line GILj−1.

In an embodiment, the fourth transistor T4 may include three or more transistors that are connected between the first node N1 and the third driving voltage line VL3.

The fifth transistor T5 includes a first electrode connected to the first driving voltage line VL1, a second electrode connected to the first electrode of the first transistor T1, and a gate electrode connected to the emission control line EMLj.

The sixth transistor T6 includes a first electrode connected to the second electrode of the first transistor T1, a second electrode connected to the anode of the light emitting diode ED, and a gate electrode connected to the emission control line EMLj.

The fifth transistor T5 and the sixth transistor T6 are turned on concurrently (e.g., at the same or substantially the same time) in response to the emission control signal EMj received through the emission control line EMLj. Accordingly, the first driving voltage ELVDD may be compensated through the first transistor T1 that is diode-connected (e.g., by the third transistor T3), and may be transferred to the light emitting diode ED.

The seventh transistor T7 includes a first electrode connected to the second electrode of the fourth transistor T4, a second electrode connected to the second electrode of the sixth transistor T6, and a gate electrode connected to the j-th second scan line GWLj.

As described above, one end of the capacitor Cst is connected to the gate electrode of the first transistor T1. Another end of the capacitor Cst is connected to the first driving voltage line VL1. A cathode of the light emitting diode ED may be connected to the second driving voltage line VL2 for transferring the second driving voltage ELVSS.

The compensation transistor Tc1 includes a first electrode connected to the first node N1, a second electrode connected to the fourth driving voltage line VL4 through which the compensation voltage VCOMP is transferred, and a gate electrode connected to the fifth driving voltage line VL5 through which the compensation control voltage VGH is transferred.

The structure of the pixel PXij is not limited to the structure illustrated in FIG. 2A, and the number of transistors included in one pixel PXij, the number of capacitors included in one pixel PXij, and the connection relationships thereof may be variously modified as needed or desired.

Figure 3:
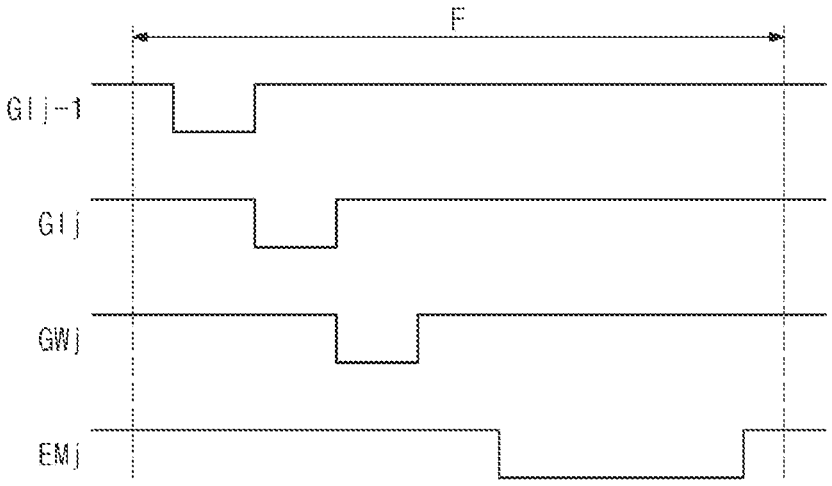
FIG. 3 is a timing diagram illustrating an operation of the pixel illustrated in FIG. 2A.

FIG. 3 is a timing diagram illustrating an operation of the pixel PXij illustrated in FIG. 2A. Operations of the display device DD according to an embodiment will be described in more detail hereinafter with reference to FIGS. 2A and 3.

Referring to FIGS. 2A and 3, the (j−1)-th first scan signal GIj−1 having a low level is provided through the (j−1)-th first scan line GILj−1 during an initialization section within one frame F. When the fourth sub-transistors T4-1 and T4-2 are turned on in response to the (j−1)-th first scan signal GIj−1 having the low level, the initialization voltage VINT is transferred to the gate electrode of the first transistor T1 through the fourth sub-transistors T4-1 and T4-2 to initialize the first transistor T1.

Subsequently, when the j-th first scan signal GIj having the low level is supplied through the j-th first scan line GILj during a data programming and compensation section within the one frame F, the third sub-transistors T3-1 and T3-2 are turned on. The first transistor T1 is diode-connected by the turned-on third sub-transistors T3-1 and T3-2, and is biased in a forward direction. Also, the second transistor T2 is turned on by the j-th first scan signal GIj having the low level. Accordingly, a voltage Di-Vth that is reduced by a threshold voltage Vth of the first transistor T1 from a voltage of the data signal Di supplied from the data line DLi is applied to the gate electrode of the first transistor T1. In more detail, a gate voltage applied to the gate electrode of the first transistor T1 may be the voltage Di-Vth.

The first driving voltage ELVDD and the voltage Di-Vth are applied to respective ends of the capacitor Cst, and charges corresponding to a voltage difference between the respective ends may be stored in the capacitor Cst.

The seventh transistor T7 is turned on by receiving the j-th second scan signal GW having the low level through the j-th second scan line GWLj. A part of the driving current Id may pass through the seventh transistor T7 as a bypass current Ibp by the seventh transistor T7.

Even when a minimum current of the first transistor T1 for displaying a black image flows as the driving current Id, when the light emitting diode ED emits light, the black image may not be properly displayed. Accordingly, the seventh transistor T7 of the pixel PXij according to an embodiment of the present disclosure may distribute a part of the minimum current of the first transistor T1 as the bypass current Ibp to a current path other than the current path toward the organic light emitting diode ED. In this case, the minimum current of the first transistor T1 may refer to a current under a condition in which the first transistor T1 is turned off, because the gate-source voltage Vgs of the first transistor T1 is less than the threshold voltage Vth. In this way, the minimum driving current (e.g., a current of 10 pA or less) under the condition of turning off the first transistor T1 is transferred to the light emitting diode ED, and an image of a black luminance is expressed. When the minimum driving current that displays a black image flows, an effect of a bypass transfer of the bypass current Ibp may be large. When a large driving current Id that displays an image, for example, such as a general image or a white image, flows, there may be little effect of the bypass current Ibp. Therefore, when the driving current Id that displays the black image flows, an emission current led of the light emitting diode ED, which is reduced by the amount of the bypass current Ibp drained from the driving current Id through the seventh transistor T7, may have the minimum amount of current at a level that may reliably represent the black image. Therefore, it may be possible to improve a contrast ratio by implementing an accurate black luminance image by using the seventh transistor T7. In an embodiment, the bypass signal is the j-th second scan signal GWj having the low level, but the present disclosure is not limited thereto.

Subsequently, during an emission section within the one frame F, the emission control signal EMj supplied from the emission control line EMLj is changed from a high level to the low level. During the emission section, the fifth transistor T5 and the sixth transistor T6 are turned on by the emission control signal EMj having the low level. Then, the driving current Id is generated according to (e.g., depending on) a voltage difference between a gate voltage of the gate electrode of the first transistor T1 and the first driving voltage ELVDD. The driving current Id is supplied to the light emitting diode ED through the sixth transistor T6, and then the emission current led flows through the light emitting diode ED.

While the j-th first scan signal GIj transferred through the first scan line GILj is at the high level, the third sub-transistors T3-1 and T3-2 should maintain or substantially maintain the turned-off state. In addition, while the first scan signal GIj−1 transferred through the (j−1)-th first scan line GILj−1 is at the high level, the fourth sub-transistors T4-1 and T4-2 should maintain or substantially maintain the turned-off state.

However, due to characteristics of the P-type transistor, even when the third sub-transistors T3-1 and T3-2 and the fourth sub-transistors T4-1 and T4-2 are turned off, a leakage current may flow.

When an amount of the leakage current flowing from the second node N2 to the first node N1 through the third sub-transistors T3-1 and T3-2 is actually the same or substantially the same as an amount of the leakage current flowing from the first node N1 to the third driving voltage line VL3 through the fourth sub-transistors T4-1 and T4-2, the amount of the leakage current flowing to the first node N1 through the third sub-transistors T3-1 and T3-2 may be the same or substantially the same as the amount of the leakage current flowing to the third driving voltage line VL3 through the fourth sub-transistors T4-1 and T4-2. In this case, because the charges charged in the capacitor Cst may not change, the emission current led flowing through the light emitting diode ED may not be affected.

Due to a process deviation and/or the like, an amount of the leakage current flowing to the first node N1 through the third sub-transistors T3-1 and T3-2 may be different from an amount of the leakage current flowing to the third driving voltage line VL3 through the fourth sub-transistors T4-1 and T4-2. In this case, the charges charged in the capacitor Cst may be discharged through the third driving voltage line VL3. A change in the quantity of electric charge charged in the capacitor Cst affects the emission current led flowing through the light emitting diode ED, and thus, the luminance of the display image may be changed.

In more detail, when the display device DD (e.g., refer to FIG. 1) operates in a low frequency mode (e.g., 30 Hz or less) and the voltage level of the initialization voltage VINT is low, the amount of the leakage current flowing to the first node N1 through the third sub-transistors T3-1 and T3-2 may be different from the amount of the leakage current flowing to the third driving voltage line VL3 through the fourth sub-transistors T4-1 and T4-2. In this case, a user may visually recognize the change in luminance of the light emitting diode ED.

The voltage generator 300 may set (e.g., may determine or may change) a voltage level of the compensation control voltage VGH provided to the gate electrode of the compensation transistor Tc1 to a level capable of turning off the compensation transistor Tc1. For example, the compensation control voltage VGH may be a high voltage corresponding to a high level of a clock signal provided to the scan driving circuit SD.

Accordingly, the compensation transistor Tc1 may maintain or substantially maintain the turned-off state in response to the compensation control voltage VGH. The leakage current may flow even when the compensation transistor Tc1, which is a P-type transistor, is turned off.

The voltage generator 300 may determine a voltage level of the compensation voltage VCOMP according to (e.g., depending on) characteristics of the pixel PXij. For example, the voltage generator 300 may output the compensation voltage VCOMP to have a voltage level corresponding to a difference between the leakage current flowing to the first node N1 through the third sub-transistors T3-1 and T3-2 and the leakage current flowing to the third driving voltage line VL3 through the fourth sub-transistors T4-1 and T4-2.

Figure 2B:
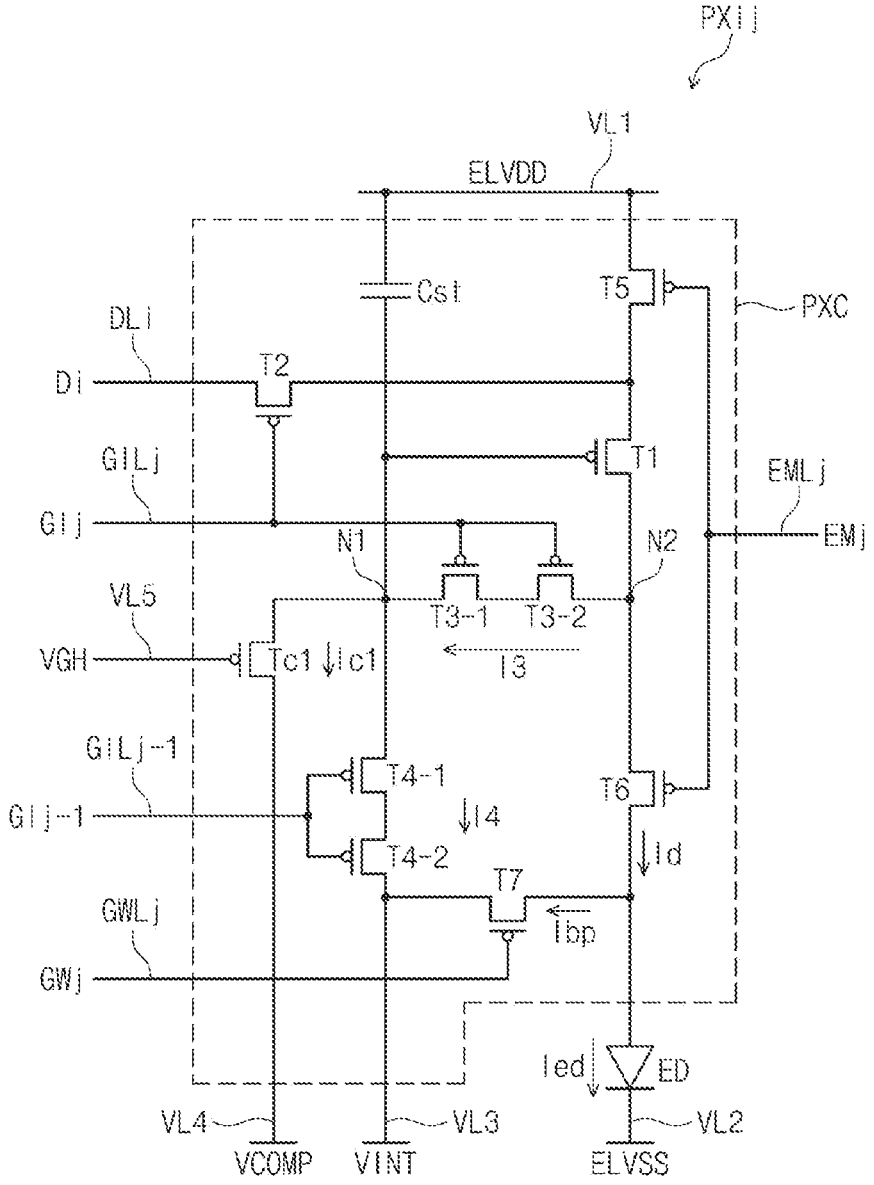
FIGS. 2B-2C are diagrams visually illustrating a leakage current flowing through third sub-transistors, fourth sub-transistors, and a compensation transistor.
Figure 2C:
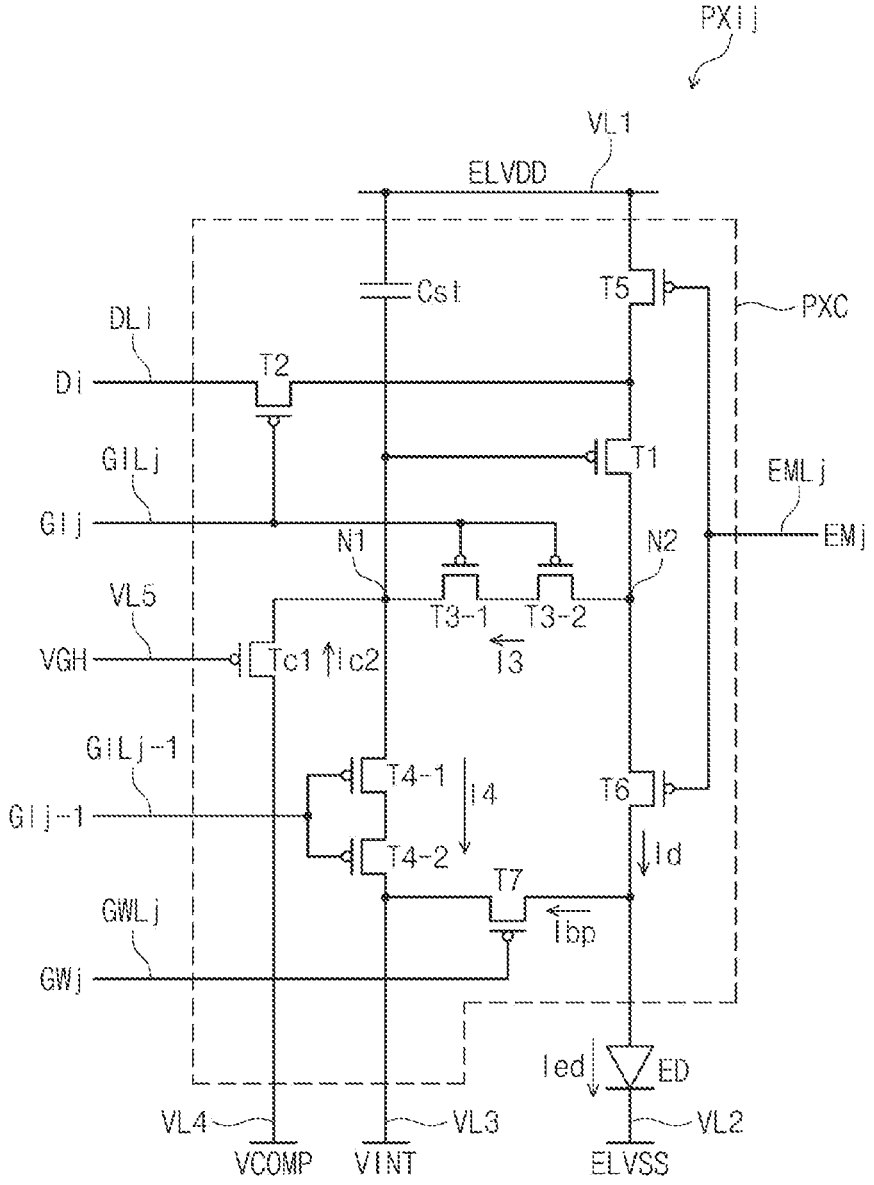

FIGS. 2B and 2C are diagrams visually illustrating a leakage current flowing through the third sub-transistors T3-1 and T3-2, the fourth sub-transistors T4-1 and T4-2, and the compensation transistor Tc1.

For example, as illustrated in FIG. 2B, when a leakage current I3 flowing through the third sub-transistors T3-1 and T3-2 is greater than a leakage current I4 flowing through the fourth sub-transistors T4-1 and T4-2, the voltage level of the compensation voltage VCOMP may be determined such that a leakage current Ic1 may flow from the first node N1 to the fourth driving voltage line VL4 through the compensation transistor Tc1.

Accordingly, a part of the leakage current I3 passing through the third sub-transistors T3-1 and T3-2 may flow through the fourth sub-transistors T4-1 and T4-2 as the leakage current I4, and another part of the leakage current I3 may flow to the fourth driving voltage line VL4 through the compensation transistor Tc1 as the leakage current Ic1. As a result, even though the amount of the leakage current I3 flowing to the first node N1 through the third sub-transistors T3-1 and T3-2 is different from the amount of the leakage current I4 flowing to the third driving voltage line VL3 through the fourth sub-transistors T4-1 and T4-2, it may be possible to minimize or reduce a change in the quantity of electric charge that is charged in the capacitor Cst.

On the other hand, as illustrated in FIG. 2C, when the leakage current I3 flowing through the third sub-transistors T3-1 and T3-2 is less than the leakage current I4 flowing through the fourth sub-transistors T4-1 and T4-2, the voltage level of the compensation voltage VCOMP may be determined such that a leakage current Ic2 flows from the fourth driving voltage line VL4 to the first node N1 through the compensation transistor Tc1.

Accordingly, the leakage current I3 flowing into the first node N1 through the third sub-transistors T3-1 and T3-2 and the leakage current Ic2 flowing into the first node N1 through the compensation transistor Tc1 may flow to the third driving voltage line VL3 through the fourth sub-transistors T4-1 and T4-2 as the leakage current I4. As a result, even though the amount of the leakage current I3 flowing to the first node N1 through the third sub-transistors T3-1 and T3-2 is different from the amount of the leakage current I4 flowing to the third driving voltage line VL3 through the fourth sub-transistors T4-1 and T4-2, a change in the quantity of electric charge that is charged in the capacitor Cst may be minimized or reduced.

Figure 4:
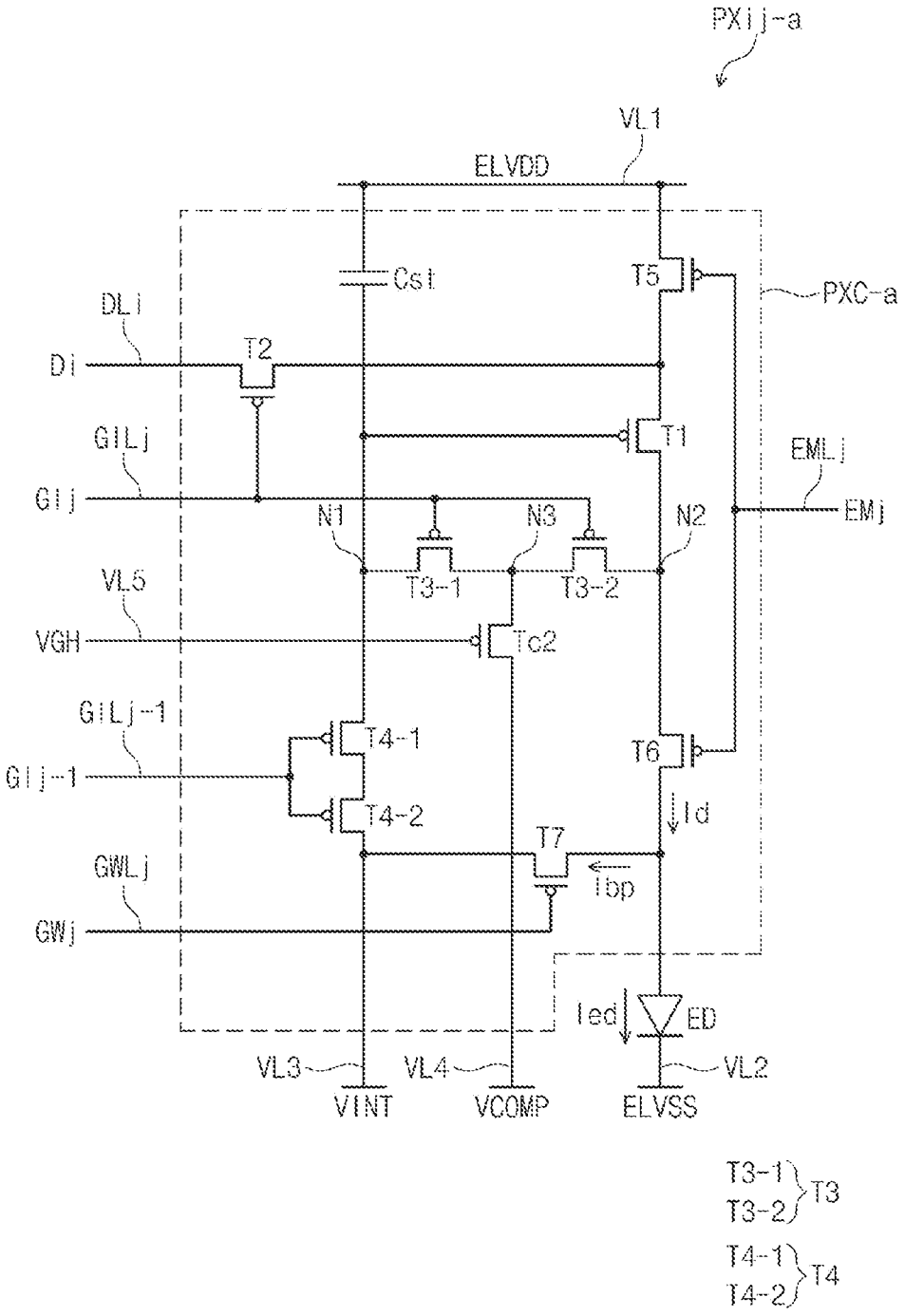
FIG. 4 is an equivalent circuit diagram of a pixel according to an embodiment of the present disclosure.

FIG. 4 is an equivalent circuit diagram of a pixel according to an embodiment of the present disclosure.

Referring to FIG. 4, a circuit unit (e.g., a pixel circuit) PXC-a of a pixel PXij-a includes the first to seventh transistors T1 to T7, a compensation transistor Tc2, and the capacitor Cst.

Because the first to seventh transistors T1 to T7 and the capacitor Cst illustrated in FIG. 4 may be the same or substantially the same as the first to seventh transistors T1 to T7 and the capacitor Cst of the circuit unit PXC illustrated in FIG. 2A, the same reference symbols are assigned to the same or substantially the same corresponding components, and thus, redundant description thereof may not be repeated.

The compensation transistor Tc2 includes a first electrode connected to a third node N3, a second electrode connected to the fourth driving voltage line VL4 through which the compensation voltage VCOMP is transferred, and a gate electrode connected to the fifth driving voltage line VL5 through which the compensation control voltage VGH is transferred. The third node N3 may be a connection node between the second electrode of the third sub-transistor T3-1 and the first electrode of the third sub-transistor T3-2.

For example, when the leakage current flowing through the third sub-transistors T3-1 and T3-2 is greater than the leakage current flowing through the fourth sub-transistors T4-1 and T4-2, the voltage level of the compensation voltage VCOMP may be determined such that a leakage current flows from the third node N3 to the fourth driving voltage line VL4 through the compensation transistor Tc2.

Accordingly, a part of the leakage current flowing through the third sub-transistors T3-1 and T3-2 may flow through the fourth sub-transistors T4-1 and T4-2, and another part thereof may flow to the fourth driving voltage line VL4 through the compensation transistor Tc2. As a result, even though the amount of the leakage current flowing to the first node N1 through the third sub-transistors T3-1 and T3-2 is different from the amount of the leakage current flowing to the third driving voltage line VL3 through the fourth sub-transistors T4-1 and T4-2, a change in the quantity of electric charge that is charged in the capacitor Cst may be minimized or reduced.

Further, when the leakage current flowing through the third sub-transistors T3-1 and T3-2 is less than the leakage current flowing through the fourth sub-transistors T4-1 and T4-2, the voltage level of the compensation voltage VCOMP may be determined such that a leakage current may flow from the fourth driving voltage line VL4 to the third node N3 through the compensation transistor Tc2.

Accordingly, the leakage current flowing into the first node N1 through the third sub-transistors T3-1 and T3-2 and the leakage current flowing into the third node N3 through the compensation transistor Tc2 may flow to the third driving voltage line VL3 through the fourth sub-transistors T4-1 and T4-2. As a result, even though the amount of the leakage current flowing to the first node N1 through the third sub-transistors T3-1 and T3-2 is different from the amount of the leakage current flowing to the third driving voltage line VL3 through the fourth sub-transistors T4-1 and T4-2, a change in the quantity of electric charge that is charged in the capacitor Cst may be minimized or reduced.

Figure 5:
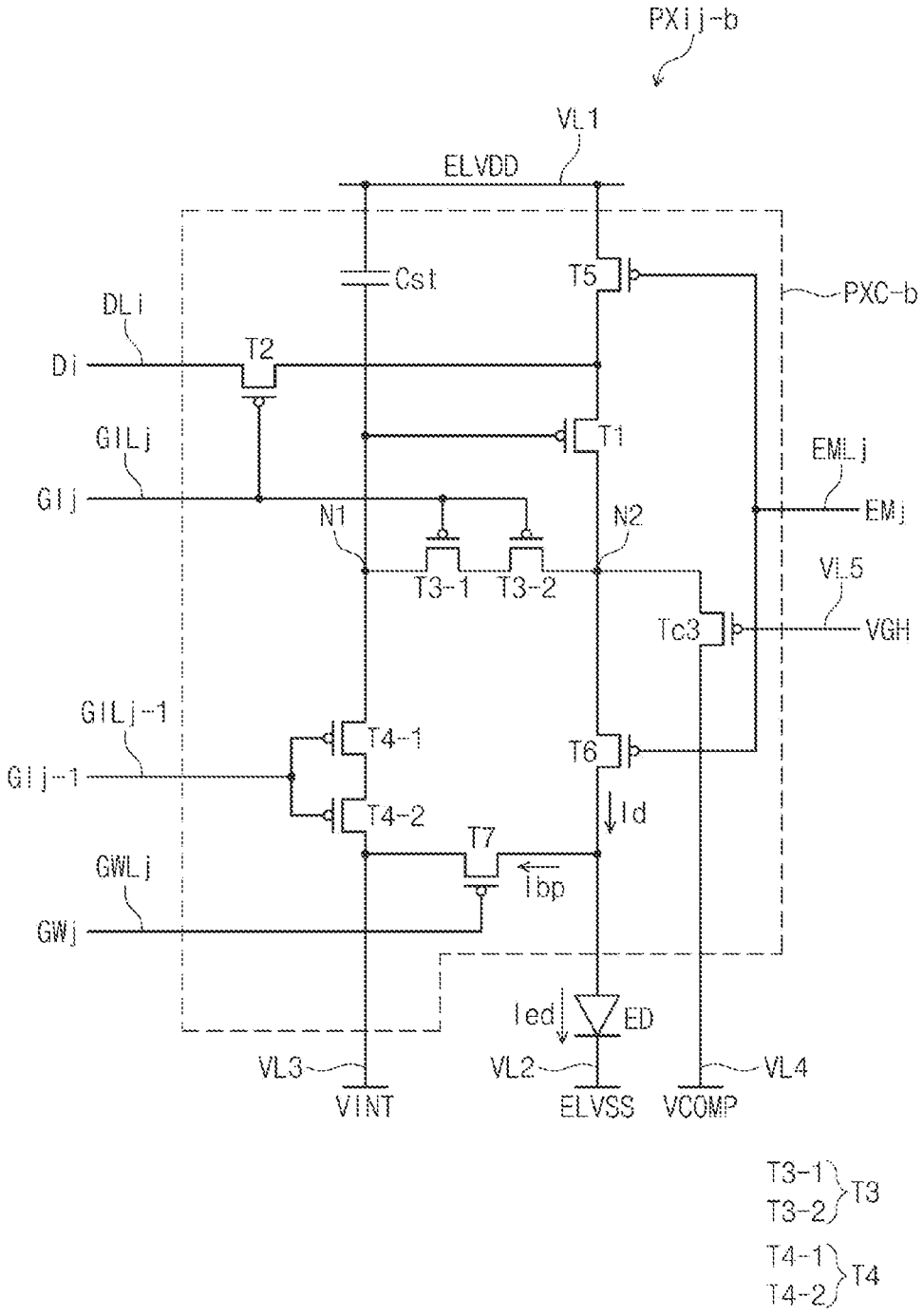
FIG. 5 is an equivalent circuit diagram of a pixel according to an embodiment of the present disclosure.

FIG. 5 is an equivalent circuit diagram of a pixel according to an embodiment of the present disclosure.

Referring to FIG. 5, a circuit unit (e.g., a pixel circuit) PXC-b of a pixel PXij-b includes the first to seventh transistors T1 to T7, a compensation transistor Tc3, and the capacitor Cst.

Because the first to seventh transistors T1 to T7 and the capacitor Cst illustrated in FIG. 5 may be the same or substantially the same as the first to seventh transistors T1 to T7 and the capacitor Cst of the circuit unit PXC illustrated in FIG. 2A, the same reference symbols are assigned to the same or substantially the same corresponding components, and thus, redundant description thereof may not be repeated.

The compensation transistor Tc3 includes a first electrode connected to the second node N2, a second electrode connected to the fourth driving voltage line VL4 through which the compensation voltage VCOMP is transferred, and a gate electrode connected to the fifth driving voltage line VL5 through which the compensation control voltage VGH is transferred.

For example, when the leakage current flowing through the third sub-transistors T3-1 and T3-2 is greater than the leakage current flowing through the fourth sub-transistors T4-1 and T4-2, the voltage level of the compensation voltage VCOMP may be determined such that a leakage current may flow from the second node N2 to the fourth driving voltage line VL4 through the compensation transistor Tc3.

Accordingly, a part of the leakage current flowing through the third sub-transistors T3-1 and T3-2 may flow through the fourth sub-transistors T4-1 and T4-2, and another part thereof may flow to the fourth driving voltage line VL4 through the compensation transistor Tc3. As a result, even though the amount of the leakage current flowing to the first node N1 through the third sub-transistors T3-1 and T3-2 is different from the amount of the leakage current flowing to the third driving voltage line VL3 through the fourth sub-transistors T4-1 and T4-2, a change in the quantity of electric charge that is charged in the capacitor Cst may be minimized or reduced.

Further, when the leakage current flowing through the third sub-transistors T3-1 and T3-2 is less than the leakage current flowing through the fourth sub-transistors T4-1 and T4-2, the voltage level of the compensation voltage VCOMP may be determined such that a leakage current may flow from the fourth driving voltage line VL4 to the second node N2 through the compensation transistor Tc3.

Accordingly, the leakage current flowing into the first node N1 through the third sub-transistors T3-1 and T3-2 and the leakage current flowing into the second node N2 through the compensation transistor Tc3 may flow to the third driving voltage line VL3 through the fourth sub-transistors T4-1 and T4-2. As a result, even though the amount of the leakage current flowing to the first node N1 through the third sub-transistors T3-1 and T3-2 is different from the amount of the leakage current flowing to the third driving voltage line VL3 through the fourth sub-transistors T4-1 and T4-2, a change in the quantity of electric charge that is charged in the capacitor Cst may be minimized or reduced.

Figure 6:
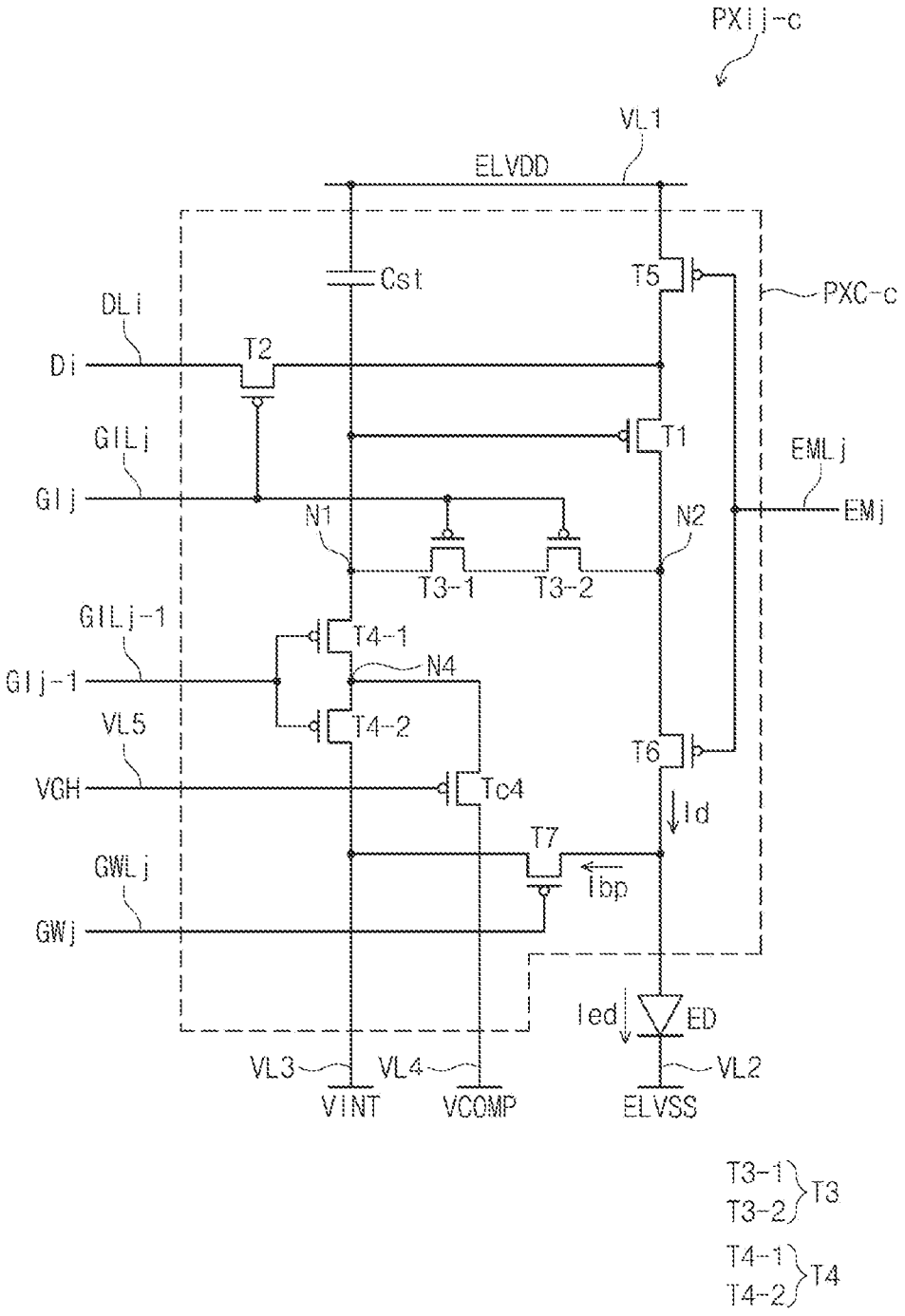
FIG. 6 is an equivalent circuit diagram of a pixel according to an embodiment of the present disclosure.

FIG. 6 is an equivalent circuit diagram of a pixel according to an embodiment of the present disclosure.

Referring to FIG. 6, a circuit unit (e.g., a pixel circuit) PXC-c of a pixel PXij-c includes the first to seventh transistors T1 to T7, a compensation transistor Tc4, and the capacitor Cst.

Because the first to seventh transistors T1 to T7 and the capacitor Cst illustrated in FIG. 6 may be the same or substantially the same as the first to seventh transistors T1 to T7 and the capacitor Cst of the circuit unit PXC illustrated in FIG. 2A, the same reference symbols are assigned to the same or substantially the same corresponding components, and redundant description thereof may not be repeated.

The compensation transistor Tc4 includes a first electrode connected to a fourth node N4, a second electrode connected to the fourth driving voltage line VL4 through which the compensation voltage VCOMP is transferred, and a gate electrode connected to the fifth driving voltage line VL5 through which the compensation control voltage VGH is transferred. The fourth node N4 is a connection node between the second electrode of the fourth sub-transistor T4-1 and the first electrode of the fourth sub-transistor T4-2.

For example, when the leakage current flowing through the third sub-transistors T3-1 and T3-2 is greater than the leakage current flowing through the fourth sub-transistors T4-1 and T4-2, the voltage level of the compensation voltage VCOMP may be determined such that a leakage current may flow from the fourth node N4 to the fourth driving voltage line VL4 through the compensation transistor Tc4.

Accordingly, a part of the leakage current flowing through the third sub-transistors T3-1 and T3-2 may flow through the fourth sub-transistors T4-1 and T4-2, and another part thereof may flow to the fourth driving voltage line VL4 through the compensation transistor Tc4. As a result, even though the amount of the leakage current flowing to the first node N1 through the third sub-transistors T3-1 and T3-2 is different from the amount of the leakage current flowing to the third driving voltage line VL3 through the fourth sub-transistors T4-1 and T4-2, a change in the quantity of electric charge that is charged in the capacitor Cst may be minimized or reduced.

Further, when the leakage current flowing through the third sub-transistors T3-1 and T3-2 is less than the leakage current flowing through the fourth sub-transistors T4-1 and T4-2, the voltage level of the compensation voltage VCOMP may be determined such that a leakage current may flow from the fourth driving voltage line VL4 to the fourth node N4 through the compensation transistor Tc4.

Accordingly, the leakage current flowing into the first node N1 through the third sub-transistors T3-1 and T3-2 and the leakage current flowing into the fourth node N4 through the compensation transistor Tc4 may flow to the third driving voltage line VL3 through the fourth sub-transistors T4-1 and T4-2. As a result, even though the amount of the leakage current flowing to the first node N1 through the third sub-transistors T3-1 and T3-2 is different from the amount of the leakage current flowing to the third driving voltage line VL3 through the fourth sub-transistors T4-1 and T4-2, a change in the quantity of electric charge that is charged in the capacitor Cst may be minimized or reduced.

Figure 7:
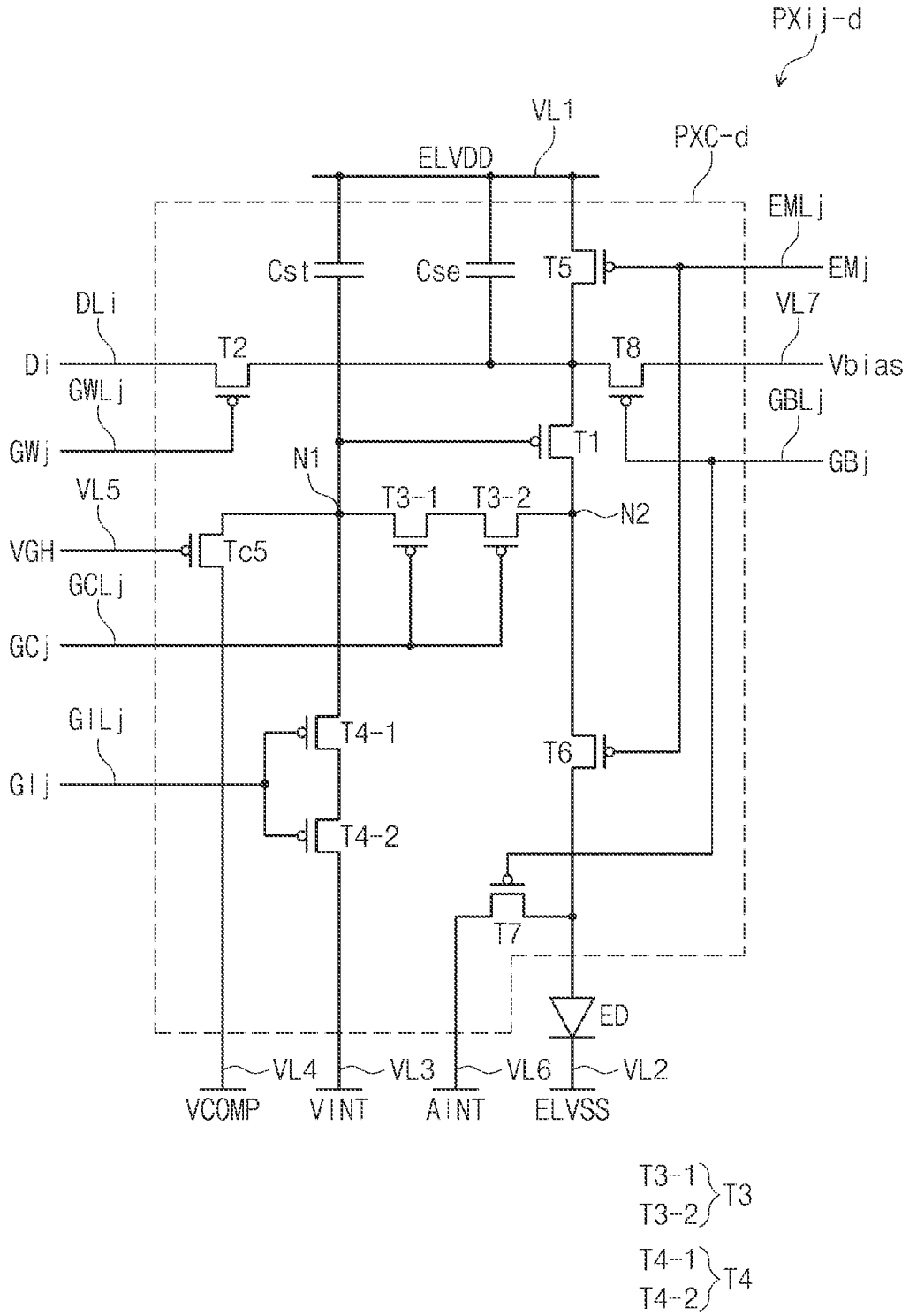
FIG. 7 is an equivalent circuit diagram of a pixel according to an embodiment of the present disclosure.

FIG. 7 is an equivalent circuit diagram of a pixel according to an embodiment of the present disclosure.

FIG. 7 illustrates an equivalent circuit diagram of a pixel PXij-d that is connected to the i-th data line DLi of the plurality of data lines DL1 to DLm, the j-th first scan line GILj of the first scan lines GIL0 to GILn, a j-th second scan line GCLj of second scan lines GCL1 to GCLn, a j-th third scan line GWLj of third scan lines GWL1 to GWLn, a j-th fourth scan line GBLj of fourth scan lines GBL1 to GBLn, and the j-th emission control line EMLj of the emission control lines EML1 to EMLn, as an example.

Referring to FIG. 7, the pixel PXij-d includes the light emitting diode ED, and a circuit unit (e.g., a pixel circuit) PXC-d. The circuit unit PXC-d includes first to eighth transistors T1 to T8, a compensation transistor Tc5, and capacitors Cst and Cse. Each of the first to eighth transistors T1 to T8 and the compensation transistor Tc5 may be a P-type transistor having a low-temperature polycrystalline silicon (LTPS) semiconductor layer. However, the present disclosure is not limited thereto, and the first to eighth transistors T1 to T8 and the compensation transistor Tc5 may be N-type transistors using an oxide semiconductor as the semiconductor layer. In an embodiment, at least one of the first to eighth transistors T1 to T8 and the compensation transistor Tc5 may be an N-type transistor, and others thereof may be a P-type transistor. In addition, the circuit configuration of the pixel PXij-d according to embodiments of the present disclosure is not limited to that shown in FIG. 7.

The j-th first scan line GILj, the j-th second scan line GCLj, the j-th third scan line GWLj, the j-th fourth scan line GBLj, and the j-th emission control line EMLj may transfer the j-th first scan signal GIj, a j-th second scan signal GCj, a j-th third scan signal GW, a j-th fourth scan signal GBj, and the emission control signal EMj, respectively. The data line DLi transfers the data signal Di. First to seventh driving voltage lines VL1, VL2, VL3, VL4, VL5, VL6, and VL7 may transfer the first driving voltage ELVDD, the second driving voltage ELVSS, the first initialization voltage VINT, the compensation voltage VCOMP, the compensation control voltage VGH, a second initialization voltage AINT, and a bias voltage Vbias, respectively.

The first transistor T1 includes a first electrode connected to the first driving voltage line VL1 through the fifth transistor T5, a second electrode electrically connected to the anode of the light emitting diode ED through the sixth transistor T6, and a gate electrode connected to one end of the capacitor Cst. The first transistor T1 may receive the data signal Di transferred from the data line DLi according to (e.g., depending on) the switching operation of the second transistor T2, and may supply the driving current Id to the light emitting diode ED.

The second transistor T2 includes a first electrode connected to the data line DLi, a second electrode connected to the first electrode of the first transistor T1, and a gate electrode connected to the j-th third scan line GWLj. The second transistor T2 is turned on in response to the third scan signal GW transferred through the j-th third scan line GWLj, and may transfer the data signal Di transferred from the data line DLi to the first electrode of the first transistor T1.

The third transistor T3 includes the third sub-transistors T3-1 and T3-2. The third sub-transistors T3-1 and T3-2 may be connected in series between the first node N1 and the second node N2. The first electrode of the third sub-transistor T3-1 is connected to the first node N1, which is connected to the gate electrode of the first transistor T1. The second electrode of the third sub-transistor T3-2 is connected to the second node N2, which is connected to the second electrode of the first transistor Ti. The gate electrodes of the third sub-transistors T3-1 and T3-2 are connected to the j-th second scan line GCLj.

The third sub-transistors T3-1 and T3-2 are turned on in response to the second scan signal GCj received through the j-th second scan line GCLj, and electrically connect the gate electrode of the first transistor T1 to the second electrode of the first transistor T1. In more detail, the first transistor T1 may be diode-connected by the third sub-transistors T3-1 and T3-2.

The fourth transistor T4 includes the fourth sub-transistors T4-1 and T4-2. The fourth sub-transistors T4-1 and T4-2 are connected in series between the first node N1 and the third driving voltage line VL3 through which the first initialization voltage VINT is transferred. The first electrode of the fourth sub-transistor T4-1 is connected to the first node N1. The second electrode of the fourth sub-transistor T4-2 is connected to the third driving voltage line VL3. The gate electrodes of the fourth sub-transistors T4-1 and T4-2 are connected to the j-th first scan line GILj.

The fourth sub-transistors T4-1 and T4-2 are turned on in response to the first scan signal GIj received through the j-th first scan line GILj, and may transfer the first initialization voltage VINT to the gate electrode of the first transistor T1 (e.g., to the first node N1) to perform the initialization operation of initializing the voltage of the gate electrode of the first transistor T1.

The fifth transistor T5 includes a first electrode connected to the first driving voltage line VL1, a second electrode connected to the first electrode of the first transistor T1, and a gate electrode connected to the j-th emission control line EMLj.

The sixth transistor T6 includes a first electrode connected to the second electrode of the first transistor T1, a second electrode connected to the anode of the light emitting diode ED, and a gate electrode connected to the j-th emission control line EMLj.

The fifth transistor T5 and the sixth transistor T6 are turned on concurrently (e.g., at the same or substantially the same time) in response to the emission control signal EMj received through the emission control line EMLj. The first driving voltage ELVDD may be compensated through the first transistor T1 that is diode-connected, and the compensated first driving voltage ELVDD may be transferred to the light emitting diode ED.

The seventh transistor T7 includes a first electrode connected to the sixth driving voltage line VL6, a second electrode connected to the second electrode of the sixth transistor T6, and a gate electrode connected to the j-th fourth scan line GBLj.

The eighth transistor T8 includes a first electrode connected to the seventh driving voltage line VL7, a second electrode connected to the first electrode of the first transistor T1, and a gate electrode connected to the j-th fourth scan line GBLj.

One end of the capacitor Cst is connected to the gate electrode of the first transistor T1, and the other end of the capacitor Cst is connected to the first driving voltage line VL1. One end of the capacitor Cse is connected to the first electrode of the first transistor T1, and the other end of the capacitor Cse is connected to the first driving voltage line VL1. The cathode of the light emitting diode ED may be connected to the second driving voltage line VL2 through which the second driving voltage ELVSS is transferred.

The compensation transistor Tc5 includes a first electrode connected to the first node N1, a second electrode connected to the fourth driving voltage line VL4 through which the compensation voltage VCOMP is transferred, and a gate electrode connected to the fifth driving voltage line VL5 through which the compensation control voltage VGH is transferred.

The compensation control voltage VGH provided to the gate electrode of the compensation transistor Tc5 may be a high voltage having a level capable of turning off the compensation transistor Tc5. For example, the compensation control voltage VGH may be the high voltage corresponding to a high level of a clock signal provided to the scan driving circuit SD.

Accordingly, the compensation transistor Tc5 may maintain or substantially maintain a turned-off state in response to the compensation control voltage VGH. A leakage current may flow even when the compensation transistor Tc5, which is a P-type transistor, is turned off.

The voltage level of the compensation voltage VCOMP may be determined according to (e.g., depending on) the characteristics of the pixel PXij-d.

The compensation transistor Tc5 may operate in the same or substantially the same manner as that of the compensation transistor Tc1 illustrated in FIGS. 2A to 2C. Accordingly, even though the amount of leakage current flowing to the first node N1 through the third sub-transistors T3-1 and T3-2 is different from the amount of leakage current flowing to the third driving voltage line VL3 through the fourth sub-transistors T4-1 and T4-2, it may be possible to minimize or reduce a change in the quantity of electric charge that is charged in the capacitor Cst.

The circuit configuration of the pixel PXij-d illustrated in FIG. 7 is different from that of the pixel PXij illustrated in FIG. 2A. However, the compensation transistor Tc5 may operate in the same or substantially the same manner as that of the compensation transistor Tc1 illustrated in FIG. 2A. In more detail, each of the compensation transistors Tc1 and Tc5 may compensate for a deviation between the leakage current flowing to the first node N1 through the third sub-transistors T3-1 and T3-2 and the leakage current flowing to the third driving voltage line VL3 through the fourth sub-transistors T4-1 and T4-2.

Figure 8:
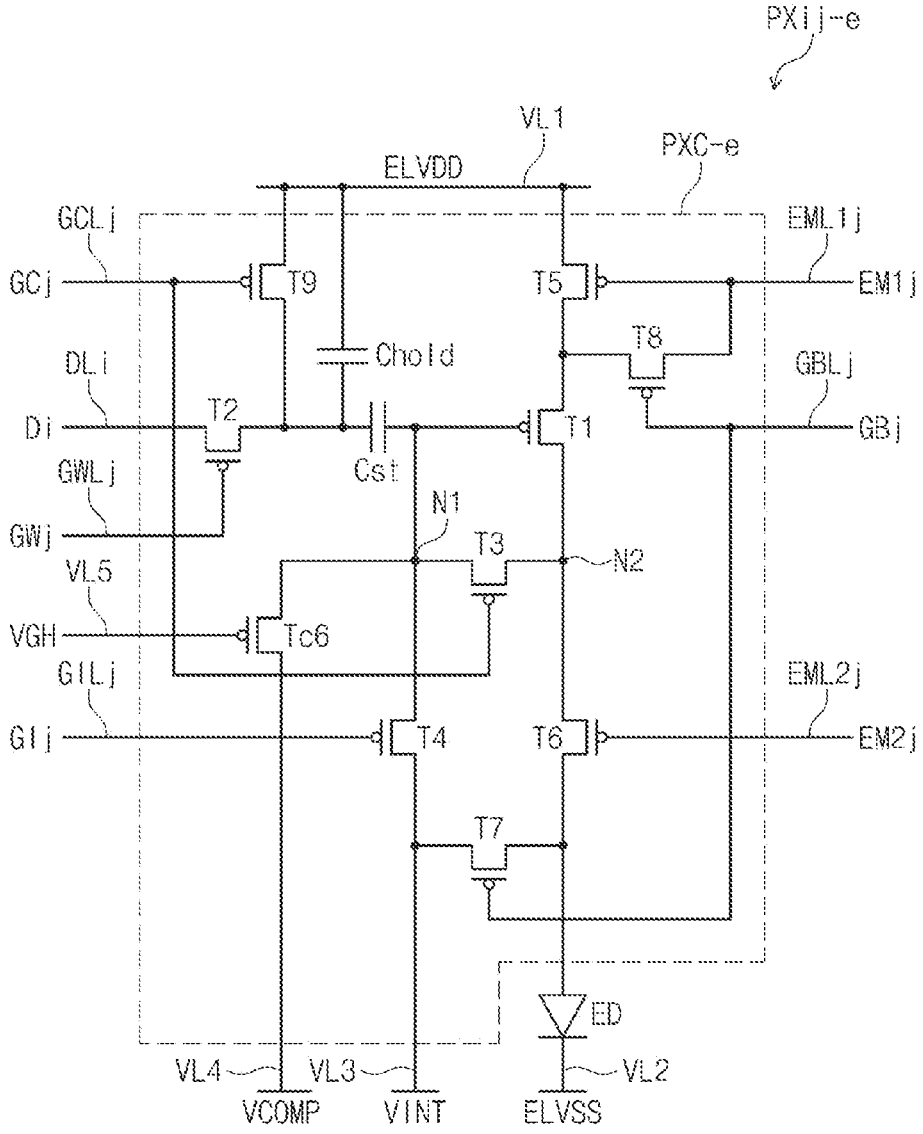
FIG. 8 is an equivalent circuit diagram of a pixel according to an embodiment of the present disclosure.

FIG. 8 is an equivalent circuit diagram of a pixel according to an embodiment of the present disclosure.

FIG. 8 illustrates an equivalent circuit diagram of a pixel PXij-e that is connected to the i-th data line DLi of the plurality of data lines DL1 to DLm, the j-th first scan line GILj of the first scan lines GIL0 to GILn, a j-th second scan line GCLj of the second scan lines GCL1 to GCLn, the j-th third scan line GWLj of the third scan lines GWL1 to GWLn, a j-th fourth scan line GBLj of the fourth scan lines GBL1 to GBLn, a j-th first emission control line EML1*j* of first emission control lines EML11 to EML1*n*, and a j-th second emission control line EML2*j* of second emission control lines EML21 to EML2*n*, as an example.

Referring to FIG. 8, the pixel PXij-e includes the light emitting diode ED, and a circuit unit (e.g., a pixel circuit)

PXC-e. The circuit unit PXC-e includes first to ninth transistors T1 to T9, a compensation transistor Tc6, and capacitors Cst and Chold. Each of the first to ninth transistors T1 to T9 and the compensation transistor Tc6 may be a P-type transistor having the low-temperature polycrystalline silicon (LTPS) semiconductor layer. However, the present disclosure is not limited thereto, and the first to ninth transistors T1 to T9 and the compensation transistor Tc6 may be N-type transistors using the oxide semiconductor as the semiconductor layer. In an embodiment, at least one of the first to ninth transistors T1 to T9 and the compensation transistor Tc6 may be an N-type transistor, and the others thereof may be a P-type transistor. Further, the circuit configuration of the pixel PXij-e according to embodiments of the present disclosure is not limited to that shown in FIG. 8.

The j-th first scan line GILj, the j-th second scan line GCLj, the j-th third scan line GWLj, the j-th fourth scan line GBLj, the j-th first emission control line EML1*j*, and the j-th second emission control line EML2*j* may transfer the j-th first scan signal GIj, the j-th second scan signal GCj, the j-th third scan signal GW, the j-th fourth scan signal GBj, a first emission control signal EM1*j*, and a second emission control signal EM2*j*, respectively. The data line DLi transfers the data signal Di. The first to fifth driving voltage lines VL1, VL2, VL3, VL4, and VL5 may transfer the first driving voltage ELVDD, the second driving voltage ELVSS, the initialization voltage VINT, the compensation voltage VCOMP, and the compensation control voltage VGH, respectively.

The first transistor T1 includes a first electrode connected to the first driving voltage line VL1 through the fifth transistor T5, a second electrode electrically connected to the anode of the light emitting diode ED through the sixth transistor T6, and a gate electrode connected to one end of the capacitor Cst. The first transistor T1 may receive the data signal Di transferred from the data line DLi according to (e.g., depending on) the switching operation of the second transistor T2, and may supply the driving current Id to the light emitting diode ED.

The second transistor T2 includes a first electrode connected to the data line DLi, a second electrode connected to another end of the capacitor Cst, and a gate electrode connected to the j-th third scan line GWLj. The second transistor T2 is turned on in response to the third scan signal GWj transferred through the j-th third scan line GWLj, and may transfer the data signal Di transferred from the data line DLi to the other end of the capacitor Cst.

The third transistor T3 is connected between the first node N1 and the second node N2, and includes a gate electrode connected to the j-th second scan line GCLj. The first node N1 is connected to the gate electrode of the first transistor T1, and the second node N2 is connected to the second electrode of the first transistor T1. The third transistor T3 is turned on in response to the second scan signal GCj received through the j-th second scan line GCLj, to electrically connect the gate electrode of the first transistor T1 to the second electrode of the first transistor T1. In more detail, the first transistor T1 may be diode-connected by the third transistor T3.

The fourth transistor T4 is connected between the first node N1 and the third driving voltage line VL3, and includes a gate electrode connected to the j-th first scan line GILj. The fourth transistor T4 is turned on in response to the first scan signal GIj received through the j-th first scan line GILj, and may transfer the initialization voltage VINT to the gate electrode of the first transistor T1 (e.g., to the first node N1), such that the initialization operation of initializing the voltage of the gate electrode of the first transistor T1 may be performed.

The fifth transistor T5 includes a first electrode connected to the first driving voltage line VL1, a second electrode connected to the first electrode of the first transistor T1, and a gate electrode connected to the j-th first emission control line EML1*j*.

The sixth transistor T6 includes a first electrode connected to the second electrode of the first transistor T1, a second electrode connected to the anode of the light emitting diode ED, and a gate electrode connected to the j-th second emission control line EML2*j*.

The seventh transistor T7 includes a first electrode connected to the third driving voltage line VL3, a second electrode connected to the second electrode of the sixth transistor T6, and a gate electrode connected to the j-th fourth scan line GBLj.

The eighth transistor T8 includes a first electrode connected to the first electrode of the first transistor T1, a second electrode connected to the j-th first emission control line EML1*j*, and a gate electrode connected to the j-th fourth scan line GBLj.

The ninth transistor T9 includes a first electrode connected to the first driving voltage line VL1, a second electrode connected to the second electrode of the second transistor T2, and a gate electrode connected to the j-th second scan line GCLj.

One end of the capacitor Cst is connected to the gate electrode of the first transistor T1, and the other end of the capacitor Cst is connected to the second electrode of the second transistor T2. One end of the capacitor Chold is connected to the other end of the capacitor Cst, and the other end of the capacitor Chold is connected to the first driving voltage line VL1. The cathode of the light emitting diode ED may be connected to the second driving voltage line VL2 through which the second driving voltage ELVSS is transferred.

The compensation transistor Tc6 includes a first electrode connected to the first node N1, a second electrode connected to the fourth driving voltage line VL4 through which the compensation voltage VCOMP is transferred, and a gate electrode connected to the fifth driving voltage line VL5 through which the compensation control voltage VGH is transferred.

The compensation control voltage VGH provided to the gate electrode of the compensation transistor Tc6 may be a high voltage having a level capable of turning off the compensation transistor Tc6. For example, the compensation control voltage VGH may be the high voltage corresponding to the high level of a clock signal provided to the scan driving circuit SD.

Accordingly, the compensation transistor Tc6 may maintain or substantially maintain the turned-off state in response to the compensation control voltage VGH. A leakage current may flow even when the compensation transistor Tc6, which is a P-type transistor, is turned off.

The voltage level of the compensation voltage VCOMP may be determined according to (e.g., depending on) the characteristics of the pixel PXij-e.

The compensation transistor Tc6 may operate in the same or substantially the same manner as that of the compensation transistor Tc1 illustrated in FIGS. 2A to 2C. Therefore, even though the amount of leakage current flowing to the first node N1 through the third transistor T3 is different from the amount of the leakage current flowing to the third driving voltage line VL3 through the fourth transistor T4, it may be possible to minimize or reduce a change in the amount of charges that is charged in the capacitor Cst.

The circuit configuration of the pixel PXij-e illustrated in FIG. 8 is different from that of the pixel PXij illustrated in FIG. 2A. However, the compensation transistor Tc6 may operate in the same or substantially the same manner as that of the compensation transistor Tc1 illustrated in FIG. 2A. In more detail, each of the compensation transistors Tc1 and Tc6 may compensate for a deviation between the leakage current flowing to the first node N1 through the third transistor T3 and the leakage current flowing to the third driving voltage line VL3 through the fourth transistor T4.

According to one or more embodiments of the present disclosure, a pixel having the above-described configurations may supply a compensation current capable of compensating for a leakage current to one end of a capacitor through a compensation transistor. Accordingly, a change in the voltage difference between both ends of the capacitor due to the leakage current may be compensated for. As a result, it may be possible to prevent or substantially prevent the display quality of an image displayed through a pixel of the display device from deteriorating.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as defined in the appended claims, and their equivalents.

What is claimed is:

1. A pixel comprising:

a capacitor electrically connected between a first voltage line and a first node, the first voltage line being configured to receive a first voltage;

a light emitting diode comprising a first electrode electrically connected to a second node, and a second electrode electrically connected to a second voltage line;

a first transistor comprising a first electrode electrically connected to the first voltage line, a second electrode connected to the second node, and a gate electrode electrically connected to the first node;

a second transistor comprising a first electrode connected to a data line, a second electrode electrically connected to the first electrode of the first transistor, and a gate electrode configured to receive a first scan signal;

a third transistor comprising a first electrode electrically connected to the first node, a second electrode electrically connected to the second node, and a gate electrode configured to receive the first scan signal;

a fourth transistor comprising a first electrode electrically connected to the first node, a second electrode electrically connected to a third voltage line configured to receive a third voltage, and a gate electrode configured to receive a second scan signal; and a compensation transistor different from the third transistor and forming a current path between the first node and a fourth voltage line configured to receive a compensation voltage, the compensation transistor comprising a first electrode electrically connected to the first node, a second electrode electrically connected to the fourth voltage line, and a gate electrode configured to receive a compensation control voltage.

2. The pixel of claim 1, further comprising:

a fifth transistor connected between the first voltage line and the first electrode of the first transistor;

a sixth transistor connected between the second node and the first electrode of the light emitting diode; and a seventh transistor connected between the third voltage line and the first electrode of the light emitting diode, and comprising a gate electrode configured to receive a third scan signal.

3. The pixel of claim 1, wherein the compensation voltage has a voltage level to compensate for a leakage current of the third transistor and a leakage current of the fourth transistor.

4. The pixel of claim 1, wherein the compensation control voltage has a voltage level configured to maintain the compensation transistor in a turned-off state.

5. The pixel of claim 1, wherein each of the third transistor, the fourth transistor, and the compensation transistor comprises a P-type transistor.

6. The pixel of claim 1, wherein the third transistor comprises:

a first sub-transistor comprising a first electrode connected to the first node, a second electrode, and a gate electrode configured to receive the first scan signal; and a second sub-transistor comprising a first electrode connected to the second electrode of the first sub-transistor, a second electrode connected to the second node, and a gate electrode configured to receive the first scan signal.

7. The pixel of claim 1, wherein the fourth transistor comprises:

a first sub-transistor comprising a first electrode connected to the first node, a second electrode, and a gate electrode configured to receive the second scan signal; and a second sub-transistor comprising a first electrode connected to the second electrode of the first sub-transistor, a second electrode connected to the third voltage line, and a gate electrode configured to receive the second scan signal.

8. A pixel comprising:

a capacitor electrically connected between a first voltage line and a first node, the first voltage line being configured to receive a first voltage;

a light emitting diode comprising a first electrode electrically connected to a second node, and a second electrode electrically connected to a second voltage line;

a first transistor comprising a first electrode electrically connected to the first voltage line, a second electrode connected to the second node, and a gate electrode electrically connected to the first node;

a second transistor comprising a first electrode connected to a data line, a second electrode electrically connected to the first electrode of the first transistor, and a gate electrode configured to receive a first scan signal;

a third transistor comprising a first electrode electrically connected to the first node, a second electrode electrically connected to the second node, and a gate electrode configured to receive the first scan signal;

a fourth transistor comprising a first electrode electrically connected to the first node, a second electrode electrically connected to a third voltage line configured to receive a third voltage, and a gate electrode configured to receive a second scan signal; and a compensation transistor different from the third transistor and configured to transfer a leakage current from the second node to a fourth voltage line configured to receive a compensation voltage, the compensation transistor comprising a first electrode electrically connected to the second node, a second electrode electrically connected to the fourth voltage line, and a gate electrode configured to receive a compensation control voltage.

9. The pixel of claim 8, further comprising:

a fifth transistor connected between the first voltage line and the first electrode of the first transistor;

a sixth transistor connected between the second node and the first electrode of the light emitting diode; and a seventh transistor connected between the third voltage line and the first electrode of the light emitting diode, and comprising a gate electrode configured to receive a third scan signal.

10. The pixel of claim 8, wherein the compensation voltage has a voltage level to compensate for a leakage current of the third transistor and a leakage current of the fourth transistor.

11. The pixel of claim 8, wherein the compensation control voltage has a voltage level configured to maintain the compensation transistor in a turned-off state.

12. The pixel of claim 8, wherein each of the third transistor, the fourth transistor, and the compensation transistor comprises a P-type transistor.

13. The pixel of claim 8, wherein the third transistor comprises:

a first sub-transistor comprising a first electrode connected to the first node, a second electrode, and a gate electrode configured to receive the first scan signal; and a second sub-transistor comprising a first electrode connected to the second electrode of the first sub-transistor, a second electrode connected to the second node, and a gate electrode configured to receive the first scan signal.

14. The pixel of claim 8, wherein the fourth transistor comprises:

a first sub-transistor comprising a first electrode connected to the first node, a second electrode, and a gate electrode configured to receive the second scan signal; and a second sub-transistor comprising a first electrode connected to the second electrode of the first sub-transistor, a second electrode connected to the third voltage line, and a gate electrode configured to receive the second scan signal.

15. A display device comprising:

a pixel; and a scan driving circuit configured to output a first scan signal and a second scan signal for driving the pixel, wherein the pixel comprises:

a capacitor electrically connected between a first voltage line and a first node, the first voltage line being configured to receive a first voltage;

a light emitting diode comprising a first electrode electrically connected to a second node, and a second electrode electrically connected to a second voltage line configured to receive a second voltage;

a first transistor comprising a first electrode electrically connected to the first voltage line, a second electrode connected to the second node, and a gate electrode electrically connected to the first node;

a second transistor comprising a first electrode connected to a data line, a second electrode electrically connected to the first electrode of the first transistor, and a gate electrode configured to receive the first scan signal;

a third transistor comprising a first electrode electrically connected to the first node, a second electrode electrically connected to the second node, and a gate electrode configured to receive the first scan signal;

a fourth transistor comprising a first electrode electrically connected to the first node, a second electrode electrically connected to a third voltage line configured to receive a third voltage, and a gate electrode configured to receive the second scan signal; and a compensation transistor different from the third transistor and forming a current path between the first node and a fourth voltage line to transfer a leakage current to the fourth voltage line, the compensation transistor comprising a first electrode electrically connected to the first node, a second electrode electrically connected to the fourth voltage line configured to receive a compensation voltage, and a gate electrode configured to receive a compensation control voltage.

16. The display device of claim 15, further comprising:

a fifth transistor connected between the first voltage line and the first electrode of the first transistor;

a sixth transistor connected between the second node and the first electrode of the light emitting diode; and a seventh transistor connected between the third voltage line and the first electrode of the light emitting diode, and comprising a gate electrode configured to receive a third scan signal.

17. The display device of claim 15, further comprising:

a voltage generator configured to generate the first voltage, the second voltage, the third voltage, the compensation voltage, and the compensation control voltage.

18. The display device of claim 17, wherein the voltage generator is configured to control a voltage level of the compensation voltage to correspond to a difference between a leakage current of the third transistor and a leakage current of the fourth transistor.

19. The display device of claim 17, wherein the voltage generator is configured to control a voltage level of the compensation control voltage to maintain the compensation transistor in a turned-off state.

20. The display device of claim 15, wherein each of the third transistor, the fourth transistor, and the compensation transistor comprises a P-type transistor.

* * * * *